US011203455B2

(12) United States Patent
Blackford et al.

(10) Patent No.: US 11,203,455 B2
(45) Date of Patent: Dec. 21, 2021

(54) WRAPPING MACHINE PRINTER ARRANGEMENT AND WRAPPING MACHINE FILM CUTTER ARRANGEMENT

(71) Applicant: ILLINOIS TOOL WORKS INC., Glenview, IL (US)

(72) Inventors: Justin T. Blackford, Sidney, OH (US); Michael A. Whitby, Tipp City, OH (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 126 days.

(21) Appl. No.: 16/691,025

(22) Filed: Nov. 21, 2019

(65) Prior Publication Data

US 2020/0087013 A1 Mar. 19, 2020

Related U.S. Application Data

(62) Division of application No. 15/482,060, filed on Apr. 7, 2017, now abandoned.

(Continued)

(51) Int. Cl.
*B26D 5/08* (2006.01)
*B26D 7/00* (2006.01)

(Continued)

(52) U.S. Cl.
CPC ..... *B65B 61/26* (2013.01); *B26D 5/08* (2013.01); *B26D 7/0006* (2013.01); *B65B 11/00* (2013.01);

(Continued)

(58) Field of Classification Search
CPC ..... B65B 11/00; B65B 11/54; B65B 11/48; B65B 11/52; B65B 11/50; B65B 25/001;

(Continued)

(56) References Cited

U.S. PATENT DOCUMENTS 3,342,661 A * 9/1967 Arvidson ..... B65C 1/021 156/360
4,543,766 A * 10/1985 Boshinski ..... B65B 11/54 53/64

(Continued)

FOREIGN PATENT DOCUMENTS

EP 0061144 9/1982
FR 1461447 12/1966

(Continued)

OTHER PUBLICATIONS

Video presentation of the ink printer Canon Imageclass Laser Copier Printer, published online by Michelle Beltran at URL https://www.youtube.com/watch?v=0kc2Hm6IYxU on Dec. 21, 2015 (Year: 2015).*

(Continued)

*Primary Examiner* — Valentin Neacsu
(74) *Attorney, Agent, or Firm* — Thompson Hine LLP

(57) ABSTRACT

A wrapping machine for wrapping trayed food products includes a wrap station at which trayed food products are wrapped and a film dispensing system for drawing out film at the wrap station. A conveying system moves trayed food products through the wrapping machine. The machine may include a printer and label apply arrangement positioned for applying labels to trayed food products after wrapping, where the printer and label apply arrangement includes a support that is pivotable between an operating position and an access position. The film dispensing system may include a knife movable for cutting the film, and opposite ends of the knife are mechanically linked via spaced apart first and second belts to maintain alignment of the opposite ends.

15 Claims, 15 Drawing Sheets

Related U.S. Application Data

(60) Provisional application No. 62/414,160, filed on Oct. 28, 2016.

(51) Int. Cl.

| | |
|---|---|
| ***B65B 11/00*** | (2006.01) |
| ***B65B 25/00*** | (2006.01) |
| ***B65B 25/06*** | (2006.01) |
| ***B65B 41/12*** | (2006.01) |
| ***B65B 45/00*** | (2006.01) |
| ***B65B 59/04*** | (2006.01) |
| ***B65B 61/06*** | (2006.01) |
| ***B65B 61/26*** | (2006.01) |
| ***B65B 65/00*** | (2006.01) |
| ***B65C 1/02*** | (2006.01) |
| ***B65C 9/46*** | (2006.01) |
| *B26D 1/08* | (2006.01) |

(52) U.S. Cl.

CPC ..... *B65B 25/001* (2013.01); *B65B 25/065* (2013.01); *B65B 41/12* (2013.01); *B65B 45/00* (2013.01); *B65B 59/04* (2013.01); *B65B 61/06* (2013.01); *B65B 65/00* (2013.01); *B65C 1/02* (2013.01); *B65C 9/46* (2013.01); *B26D 1/085* (2013.01)

(58) Field of Classification Search

CPC ... B65B 25/065; B65B 25/061; B65B 25/068; B65B 57/08; B65B 57/005; B65B 57/16; B65B 57/00; B65B 2011/002

USPC ..... 53/77, 131.5, 131.4, 389.2, 136.3, 450, 53/203, 461, 463; 156/DIG. 47, 156/DIG. 37–DIG. 42

See application file for complete search history.

(56) References Cited

U.S. PATENT DOCUMENTS 4,548,024 A * 10/1985 Fine ..... B65B 11/54 53/136.1
4,615,757 A * 10/1986 Treiber ..... B65C 9/36 156/350
4,705,588 A * 11/1987 Treiber ..... B65C 1/023 156/360
4,779,500 A 10/1988 Bennett
4,825,626 A * 5/1989 Treiber ..... B65B 11/54 53/131.2
4,928,229 A * 5/1990 Teraoka ..... B65C 9/46 177/25.15
4,944,135 A * 7/1990 Treiber ..... B65B 11/54 198/464.2
5,144,787 A 9/1992 Whitby
5,221,405 A 6/1993 Trouteaud
5,238,099 A 8/1993 Schroeder
5,254,189 A * 10/1993 Hirobe ..... B65C 1/021 156/360
5,383,326 A 1/1995 Dean et al.
5,684,275 A * 11/1997 Tolson ..... B65C 1/02 177/119
5,897,741 A 4/1999 Mills et al.
6,142,208 A 11/2000 Eberhardt, Jr.
6,170,236 B1 * 1/2001 Whitby ..... B65B 11/54 53/441
6,247,292 B1 6/2001 Whitby
6,374,580 B1 4/2002 Kujubu
6,595,259 B2 7/2003 Whitby
6,658,820 B2 12/2003 Whitby
6,761,100 B1 7/2004 Oncken
6,851,250 B2 2/2005 Whitby
6,970,769 B2 * 11/2005 Rice ..... G16H 70/40 700/216
7,185,689 B2 * 3/2007 Jenkins ..... B65C 1/021 156/350
7,313,894 B2 * 1/2008 Mise ..... B65B 11/54 156/560
7,354,498 B2 * 4/2008 Jenkins ..... B65C 1/021 156/277
7,386,968 B2 * 6/2008 Sperry ..... B65B 59/02 53/411
8,393,133 B2 3/2013 Parmley
9,394,071 B2 * 7/2016 Yamasita ..... B65C 9/36
2005/0017995 A1 * 1/2005 Pferrer ..... B65C 1/02 347/2
2005/0193684 A1 * 9/2005 Mise ..... B65C 9/46 53/64
2005/0230895 A1 10/2005 Kawatsu
2006/0147588 A1 * 7/2006 Garwood ..... B65D 81/2076 426/392
2008/0025908 A1 1/2008 Totani
2012/0193022 A1 * 8/2012 Yamasita ..... B65C 9/42 156/249
2014/0147183 A1 * 5/2014 Koshida ..... G03G 21/1633 399/388
2014/0151248 A1 * 6/2014 Hurst ..... A45C 13/1069 206/45.23
2016/0039552 A1 * 2/2016 Koyama ..... B65B 11/54 53/556
2016/0101887 A1 * 4/2016 McKinnon ..... B65C 9/06 156/350
2017/0082967 A1 * 3/2017 Nishio ..... G03G 15/80
2017/0355091 A1 12/2017 Hsu
2018/0002045 A1 1/2018 Tai
2018/0118395 A1 * 5/2018 Guzman ..... B65B 57/00
2020/0071014 A1 * 3/2020 Kirsch ..... B65B 11/00

FOREIGN PATENT DOCUMENTS

JP 2016050791 4/2016
WO WO 2016121496 8/2016

OTHER PUBLICATIONS

Web page: https:/ /www.assemblymag.com/articles/92657-electric-vs-pneumatic-actuators.

* cited by examiner

WRAPPING MACHINE PRINTER ARRANGEMENT AND WRAPPING MACHINE FILM CUTTER ARRANGEMENT

TECHNICAL FIELD

This application relates generally to wrapping machines and, more specifically, to a wrapping machine printer arrangement and/or a wrapping machine film cutter arrangement.

BACKGROUND

Wrapping machines are frequently used to automatically wrap film about product, such as trayed food items. The machines typically include a film gripper that grips and pulls the film from a roll of film, side clamps that grip the film, a film cutter, and folders that fold the film underneath the product. After wrapping, a printed label is typically applied to the product (e.g., identifying product by name, weight and/or price).

A variety of issues can arise in a complex machine of this type, including film knife jams or other film knife malfunctions.

Assuring operator access to components, such as the printer, is also important.

It would be desirable to provide an automated wrapping machine with a printer arrangement that assures both proper operation for wrap purposes and operator access and/or a film knife arrangement that reduces knife malfunctions.

SUMMARY

In one aspect, a wrapping machine for wrapping trayed food products includes a wrap station at which trayed food products are wrapped, a film dispensing station for drawing out film over trayed food products at the wrap station and a conveying system for moving trayed food products along a defined path from an input station to the wrap station. A printer and label apply arrangement includes a support frame that is pivotable between an operating position and an access position. A sensor arrangement is provided for detecting when the support frame is in the operating position.

In another aspect, a wrapping machine for wrapping trayed food products includes a printer and label apply arrangement positioned for applying labels to trayed food products after wrapping. The printer and label apply arrangement includes a support that is pivotable between an operating position and an access position. The wrapping machine further includes at least one of: (i) a latch for releasably holding the support in the operating position; or (ii) a sensor arrangement for detecting when the support is in the operating position; or (iii) an operator interface mounted to the support for movement therewith during pivot of the support; or (iv) a stop bumper mounted to the support for movement therewith and engageable with a stop surface of the wrapping machine when the support is moved into the operating position; or (v) the printer and label apply arrangement including a printer housing with a movable door for label replacement, the movable door facing away from a front of the wrapping machine when the support is in the operating position, when the support is in the access position the movable door is more readily accessible from the front of the machine.

In a further aspect, a wrapping machine includes a wrap station at which trayed food products are wrapped and a film dispensing system for drawing out film at the wrap station.

A conveying system moves trayed food products through the wrapping machine. A printer and label apply arrangement is positioned for applying labels to trayed food products after wrapping. The printer and label apply arrangement includes a support that is movable between an operating position for label application and an access position for changing out a label supply.

In yet another aspect, a wrapping machine for wrapping trayed food products includes a wrap station at which trayed food products are wrapped, a film dispensing system for drawing out a film at the wrap station and a conveying system for moving trayed food products to the wrap station. The film dispensing system includes a knife movable for cutting the film, and opposite ends of the knife are mechanically linked via spaced apart first and second belts to maintain alignment of the opposite ends.

In still another aspect, a wrapping machine for wrapping trayed food products includes a wrap station at which trayed food products are wrapped, a film dispensing system for drawing out a film at the wrap station and a conveying system for moving trayed food products to the wrap station. The film dispensing system includes an elongated knife movable for cutting the film, a linear actuator positioned at a lateral mid-point of the elongated knife for effecting movement of the elongated knife in a direction substantially perpendicular to an elongated axis of the elongated knife, and a belt arrangement mechanically linking the opposite ends of the elongated knife to force substantially synchronized movement of the opposite ends so as to inhibit jamming.

The details of one or more embodiments are set forth in the accompanying drawings and the description below. Other features, objects, and advantages will be apparent from the description and drawings, and from the claims.

DETAILED DESCRIPTION

Figure 1:
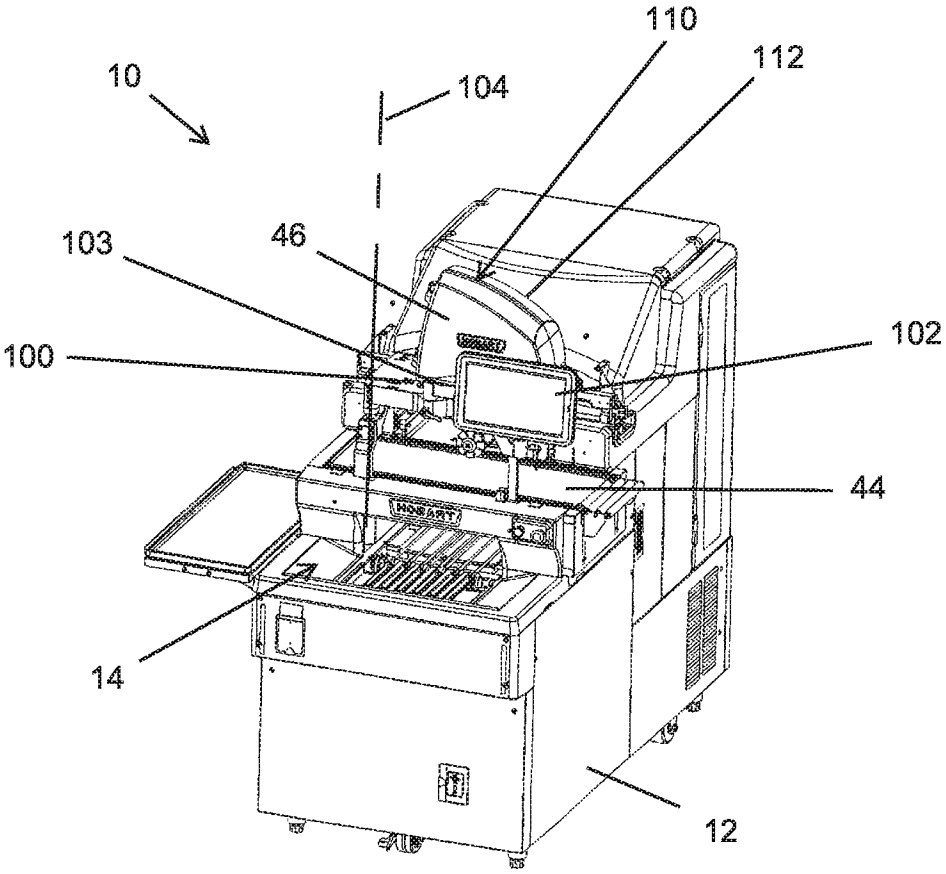
FIG. 1 is a front perspective view of a wrapping machine with printer in operating position.
Figure 2:
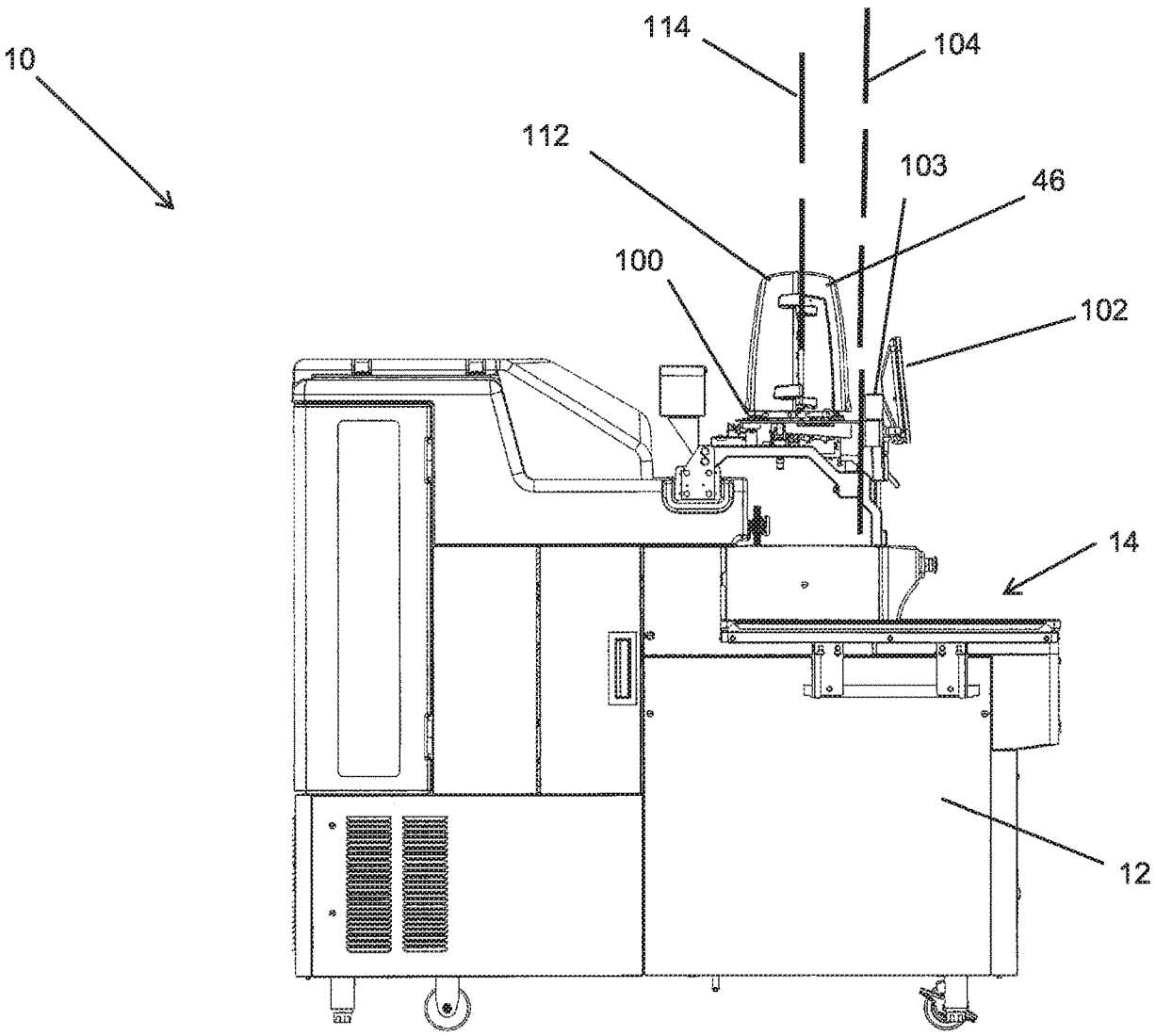
FIG. 2 is a side elevation view of the wrapping machine with printer in operating position.
Figure 3:
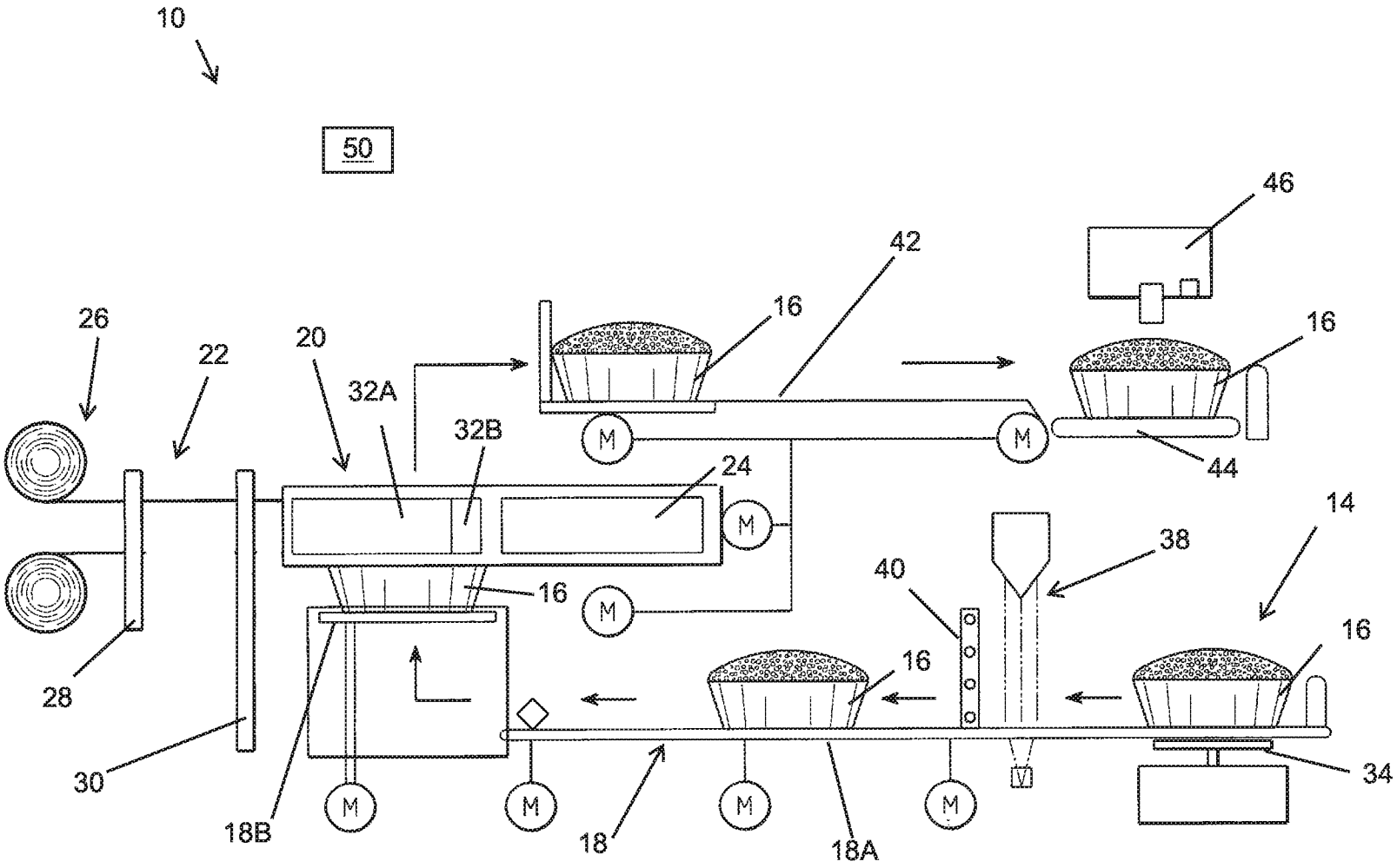
FIG. 3 is a schematic side view showing package movement through the wrapping machine for wrapping.
Figure 4:
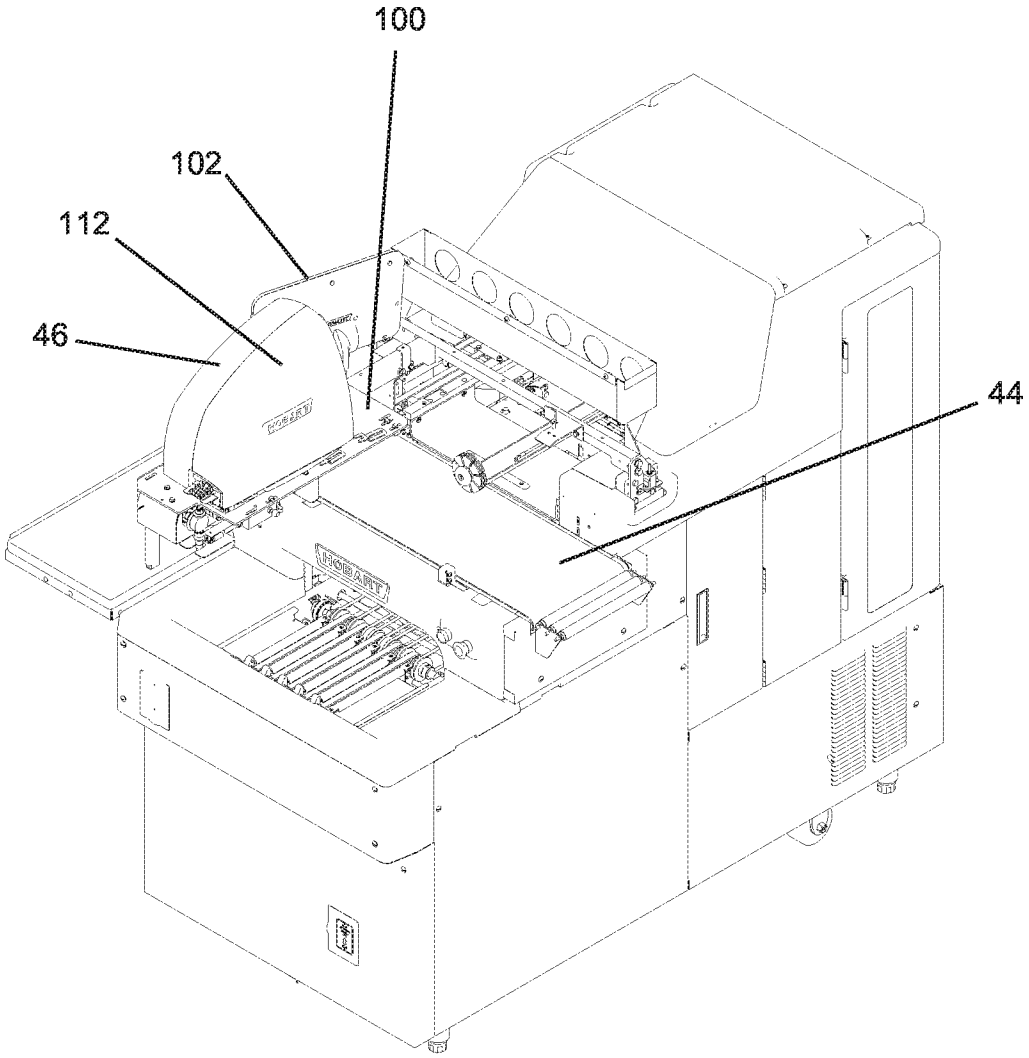
FIG. 4 is a front perspective view of the wrapping machine with printer in access position.
Figure 5:
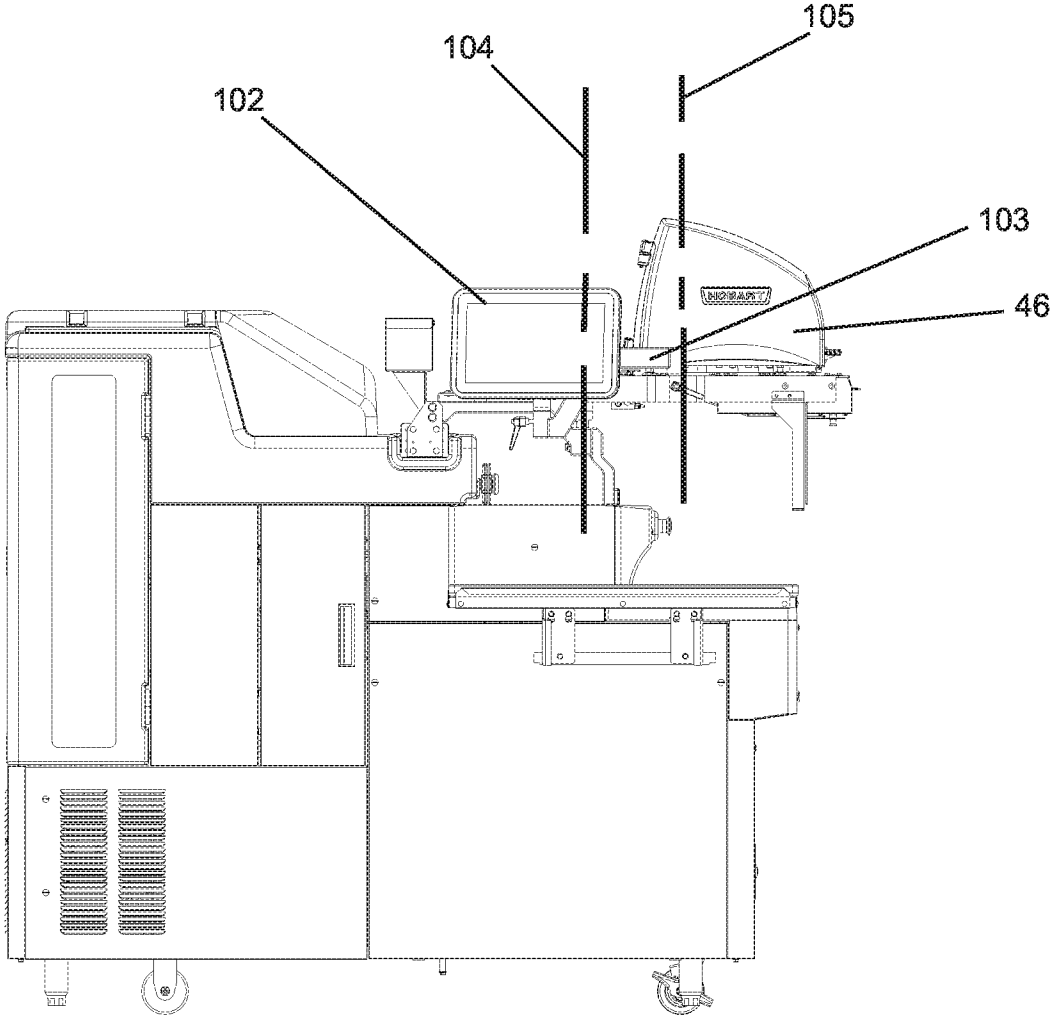
FIG. 5 is a side elevation view of the wrapping machine with printer in access position.

Referring to FIGS. 1-3, a food product wrapping machine 10 includes an inner frame and outer housing 12. An inlet area 14 provides a location at which products to be wrapped (e.g., food items 16, such as meats in trays) are input to the machine for wrapping in plastic film. The inlet area 14 is part of a conveying system 18 that carries packages into the machine (right to left in FIGS. 2 and 3) and then up into a wrap station 20 at which the food products are wrapped. Here the conveying system includes one or more horizontal conveyors 18A that feed from the front of the machine back to an elevator mechanism 18B. A film dispensing system 22 is provided for drawing out film over food products at the wrap station 20 (e.g., under control of a film gripper 24 that moves left to right in FIG. 3 in order to draw off film from one or more film rolls 26). Where more than one film roll is provided (e.g., of differing film widths), an actuatable film selector 28 provides the ability to select the desired film for a given wrap operation (e.g., depending upon size of the food product). An actuatable film knife 30 is provided to cut the film at the appropriate time to enable the wrap operation to be completed. The wrap station may include side clamps 32A, 32B to grip the lateral sides of the film, as well as side underfolders and a rear underfolder (not shown).

A weighing mechanism 34 is located at the inlet area for weighing the food product as it is placed into the machine. Once a stable weight is determined, the food product 16 is moved laterally into the machine through a light curtain imaging system 38 and past a height sensor array 40 for determining size of the food product and location of the food product on the conveyor. Part of the horizontal conveying system 18A may be shifted (e.g., into or out of the page in FIG. 3) as necessary to assure that the food product is properly centered when it is transferred onto the elevator mechanism 18B. After the food product is moved up into the wrap station 20 and wrapped, the wrapped food product is conveyed by a conveyor 42 back toward the front of the machine and deposited onto another horizontal conveyor 44, which here moves left or right (into or out of the page in FIG. 3). The conveyor 44 includes an associated sealer belt that heats the bottom of the wrapped food product to seal the film, and a label printing mechanism 46 prints and applies a pricing label to the wrapped food product. An exemplary controller 50 is shown for controlling machine operation. As used herein, the term controller is intended to broadly encompass any circuit (e.g., solid state, application specific integrated circuit (ASIC), an electronic circuit, a combinational logic circuit, a field programmable gate array (FPGA)), processor(s) (e.g., shared, dedicated, or group—including hardware or software that executes code), software, firmware and/or other components, or a combination of some or all of the above, that carries out the control functions of the machine or the control functions of any component thereof.

Various motors M are shown and are used primarily for movement of the conveyor components, gripper components and underfolders. However, a plurality of pneumatic components may also be provided for control of components, where each pneumatic component is actuatable by delivery of pressurized air.

Per FIGS. 1, 2, 4 and 5, the wrapping machine includes a printer support 100 (e.g., platform or other support frame) above the conveyor 44. Printer 46 sits atop the support 100. An operator interface 102 (e.g., in the form of a touch-screen display) is also mounted to the support 100 via an arm 103 that pivots about a vertical axis 105 (or multiple axes where the arm is formed by multiple pivotable segments) relative to the support. The support 100 is pivotably mounted to the machine to move between an operating position (FIGS. 1 and 2) and an access position (FIGS. 4 and 5) by pivoting about a pivot axis 104. Thus, here, both the printer 46 and the operator interface 102 move with the support 100.

In the illustrated embodiment, when in an operating position the support 100 is positioned over the sealer belt conveyor 44 of the machine to position the printer 46 appropriately for applying labels to wrapped packages on the sealer belt conveyor 44, where the sealer belt runs in a lateral direction from side to side of the machine, and when moving to the access position the support 100 pivots about pivot axis 104 toward a front side of the machine (e.g., where an operator stands to place packages into the inlet area 14 of the machine). A printer housing 110 of the printer 46 includes a movable door 112 on one side for label replacement (e.g., the door is openable to change out a label roll). Here, the movable door 112 (e.g., hinged about axis 114) faces away from the front of the wrapping machine when the support 100 is in the operating position (per FIG. 1), and when the support 100 is in the access position the movable door 112 is more readily accessible from the front of the machine (per FIG. 4). However, it is recognized that in some cases the printer 46 may be positioned on the support in a position that is rotated 180 degrees to that shown.

Figure 6:
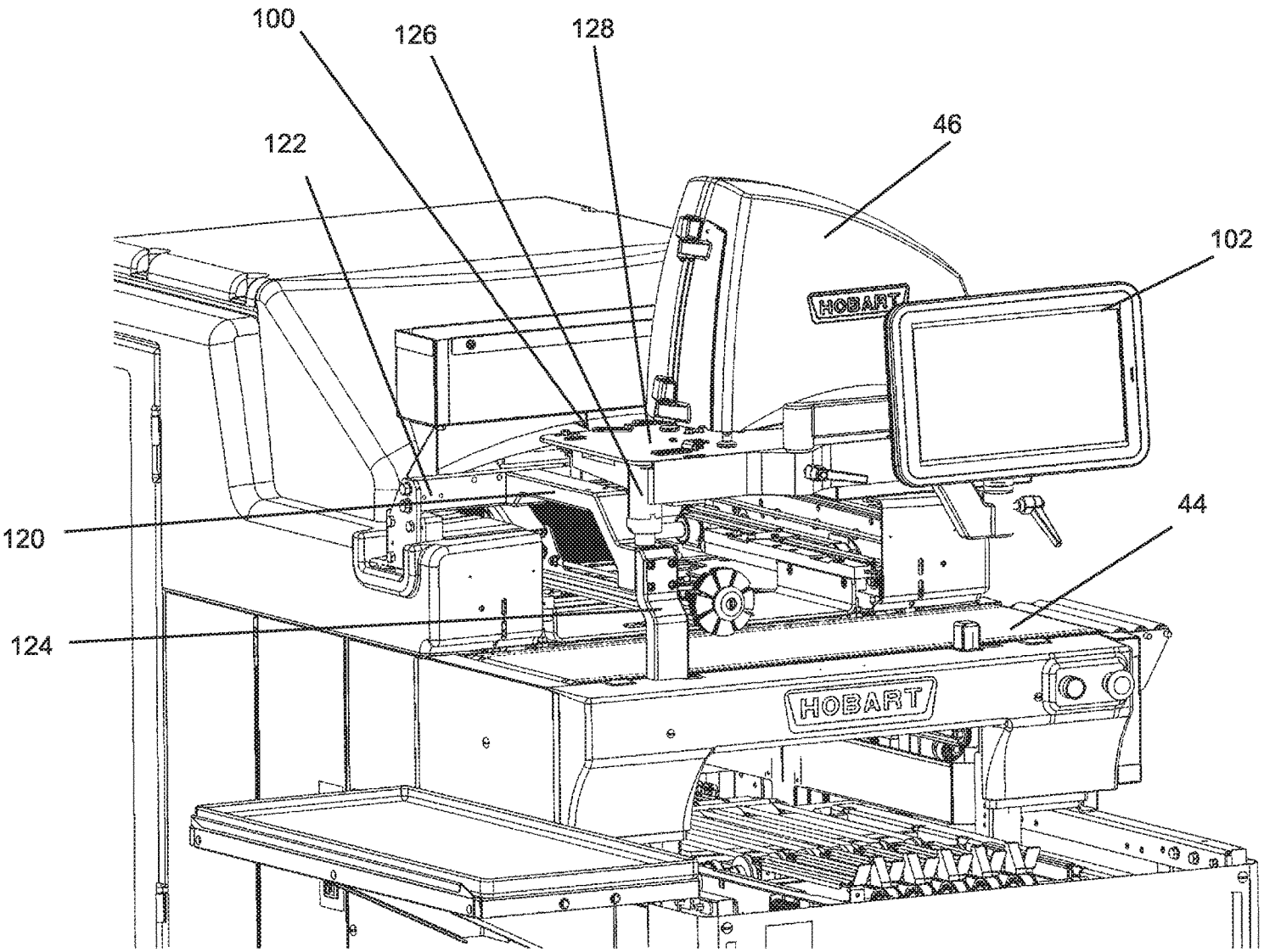
FIG. 6 is a partial front perspective showing the printer support mount.
Figure 7:
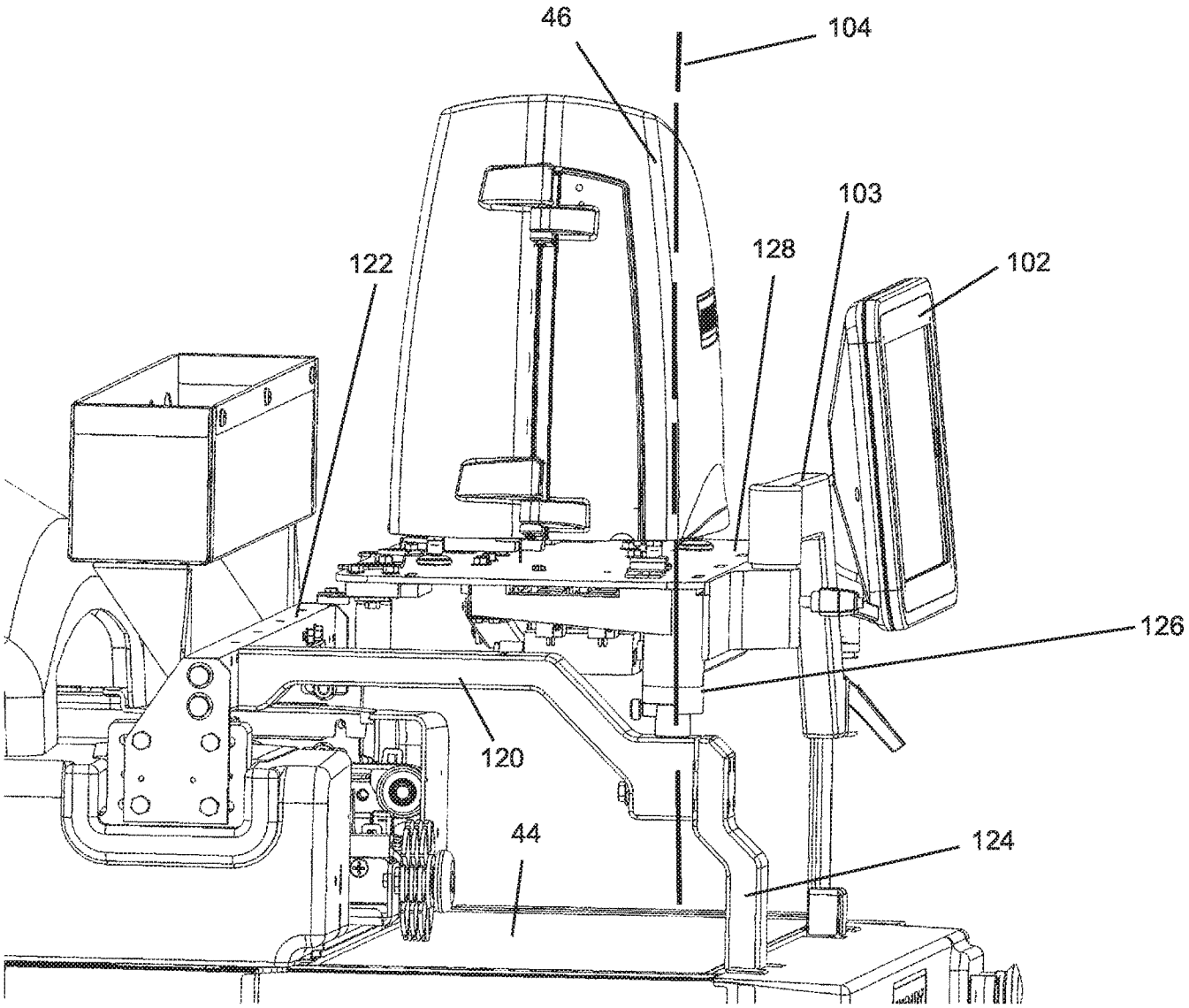
FIG. 7 is a partial side perspective showing the printer support mount.
Figure 8:
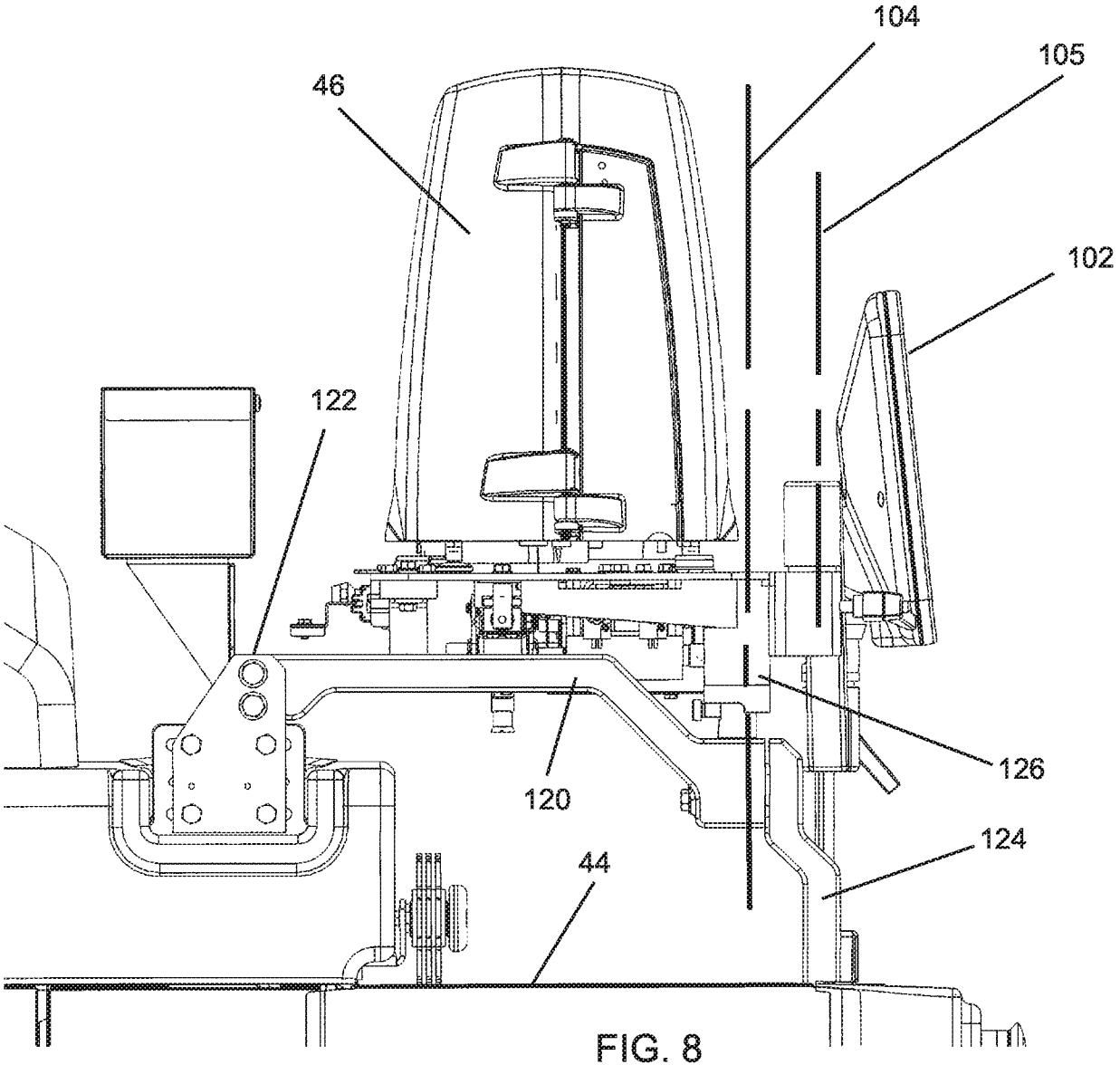
FIG. 8 is a partial side elevation showing the printer support mount.

Referring to the enlarged partial views of FIGS. 6-8, in terms of the pivotable mount of the support 100, a machine arm 120 includes a rear side mounted to a bracket 122 and extends forward over the top of the sealer belt 44 to an upright arm 124 at the front side of the sealer belt 44 and a pivot assembly 126 is mounted to the arm 120 and/or arm 124. The pivot assembly 126 forms part of the support 100 and extends upward to a platform 128 of the support. The pivot axis 104 is thus placed toward the front side of the sealer belt 44.

Figure 9:
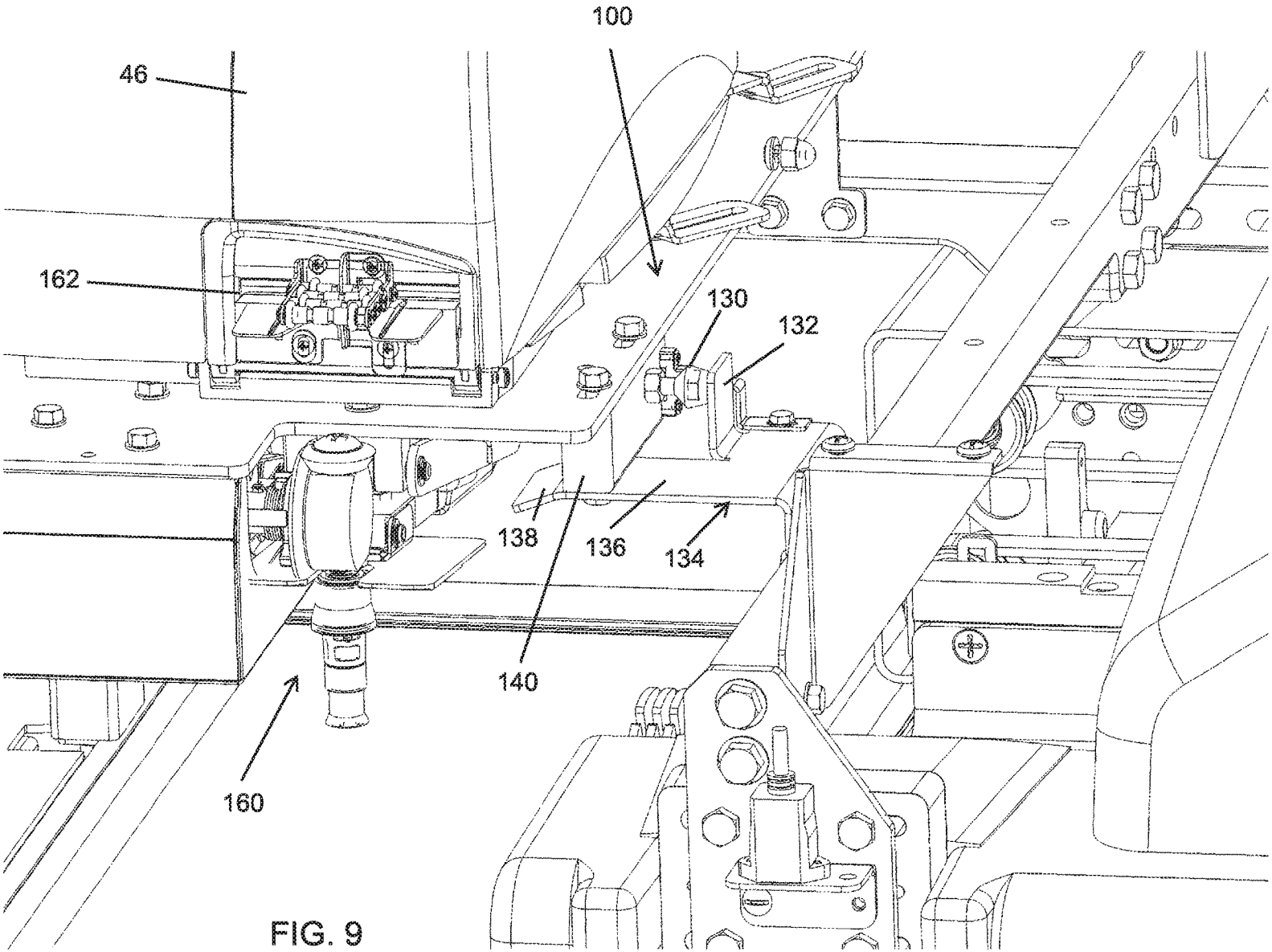
FIG. 9 is a partial side perspective showing a support bumper and latch arrangement.
Figure 10:
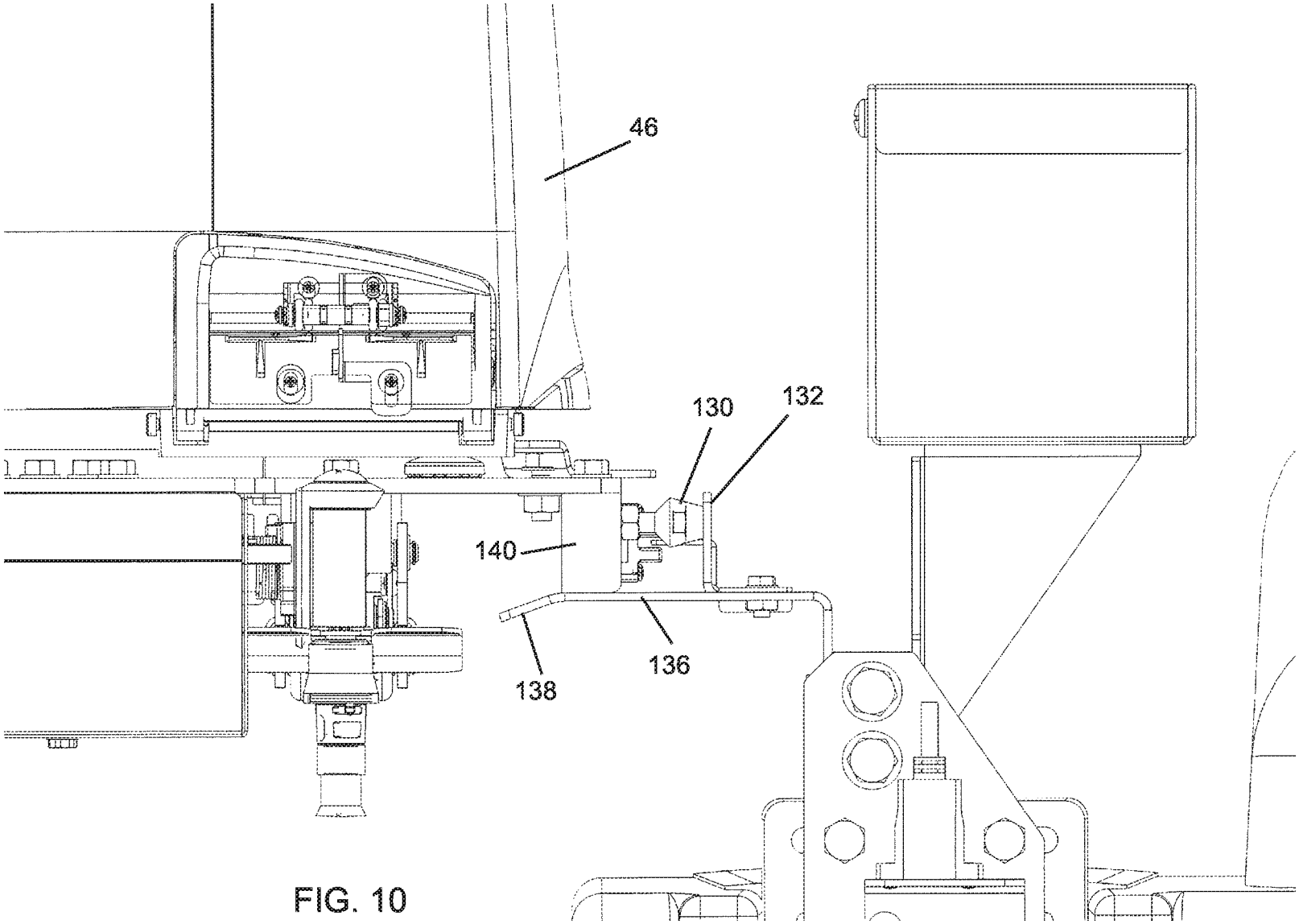
FIG. 10 is a side elevation of FIG. 9.
Figure 11:
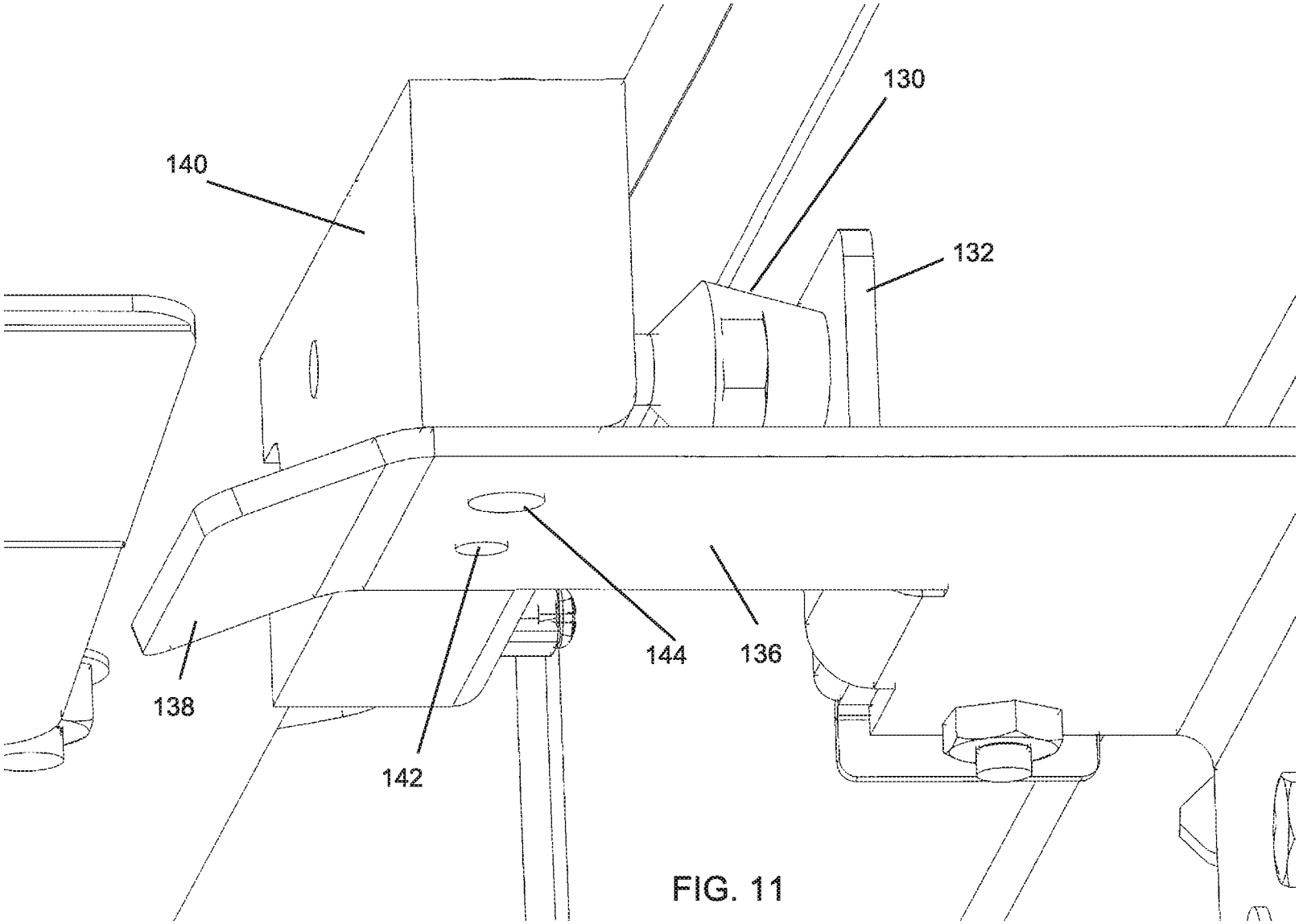
FIG. 11 is a partial bottom perspective of the bumper and latch arrangement.

As seen in FIGS. 9 and 10, the support 100 includes a bumper 130 mounted at its rear side that will engage with a stop plate 132 mounted to the wrapping machine when the support 100 is moved from the access position into the illustrated closed position. Thus, the bumper 130 moves with the support 100. However, in other arrangements the bumper may be fixed to the wrapping machine for engaging a stop surface of the support 100. Here, the stop plate 132 is formed by an upturned portion of a support bracket 134 that includes a portion 136 that extends below the support to facilitate a releasable latching operation to hold the support in the illustrated closed position. Portion 136 includes a distal end part 138 that is angled downward to provide an upper surface that acts as a ramp to receive a mount block 140 at the underside of the support, where the bumper 130 is connected to the mount block 140 and the bumper also includes a latching part (not shown in FIGS. 9 and 10) at its underside for latching with bracket portion 136. In this regard, in one implementation a ball and detent latch arrangement may be used, as depicted by reference to the bottom perspective views of FIGS. 11 and 12. Here, bracket portion 136 includes a pair of openings 142 and 144. The underside of the mount block 140 includes a projecting spring-loaded ball 146 that aligns with opening 142 when the support is moved to the operating position so that the ball 146 will engage with the opening 142, with the opening 142 acting as the detent for the ball and detent latch arrangement. Pulling the support with sufficient force will overcome the latching force of the arrangement to enable the support to move to the access position. Of course, other latching arrangements could be used, such as a magnetic catch or other mechanical latches.

Notably, the rear lower edge 148 of the mount block 140 is radiused to facilitate sliding interaction with the ramp surface of end part 138 when the support is moved back to the operating position. The mount block also includes an internally threaded opening 150 that aligns with the opening 144 when the support is in the operating position. A fastener (e.g., bolt not shown) can be engaged upwardly through the aligned openings 144 and 150 to more securely hold the support in the operating position if desired (e.g., for shipping purposes).

As seen in FIG. 9, a label applying wand 160 is disposed proximate a label exit slot 162 of the printer 46 and is also mounted for pivotable movement with the support 100.

Figure 12:
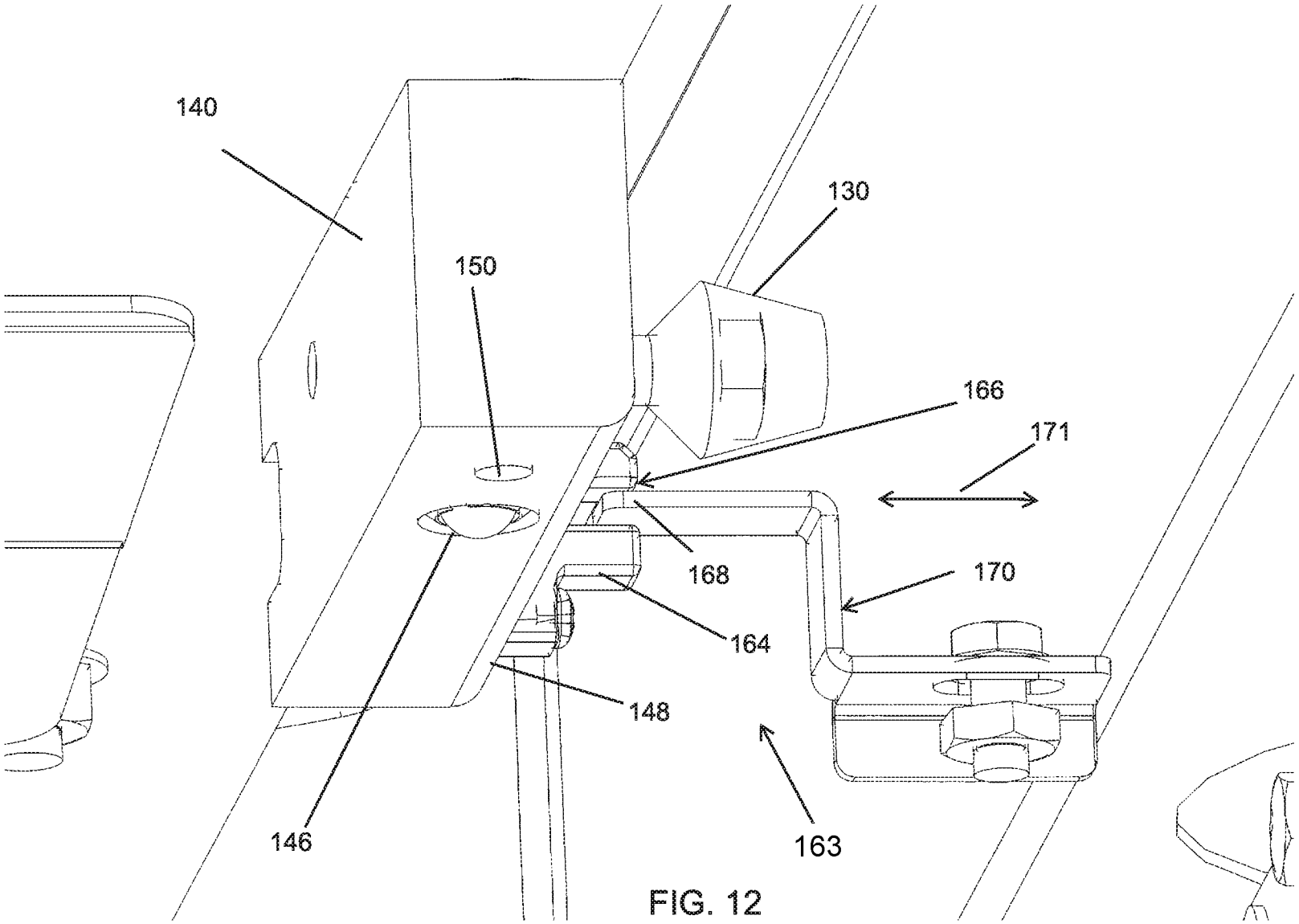
FIG. 12 is a partial bottom perspective of the bumper and latch arrangement with plate member not shown.
Figure 13:
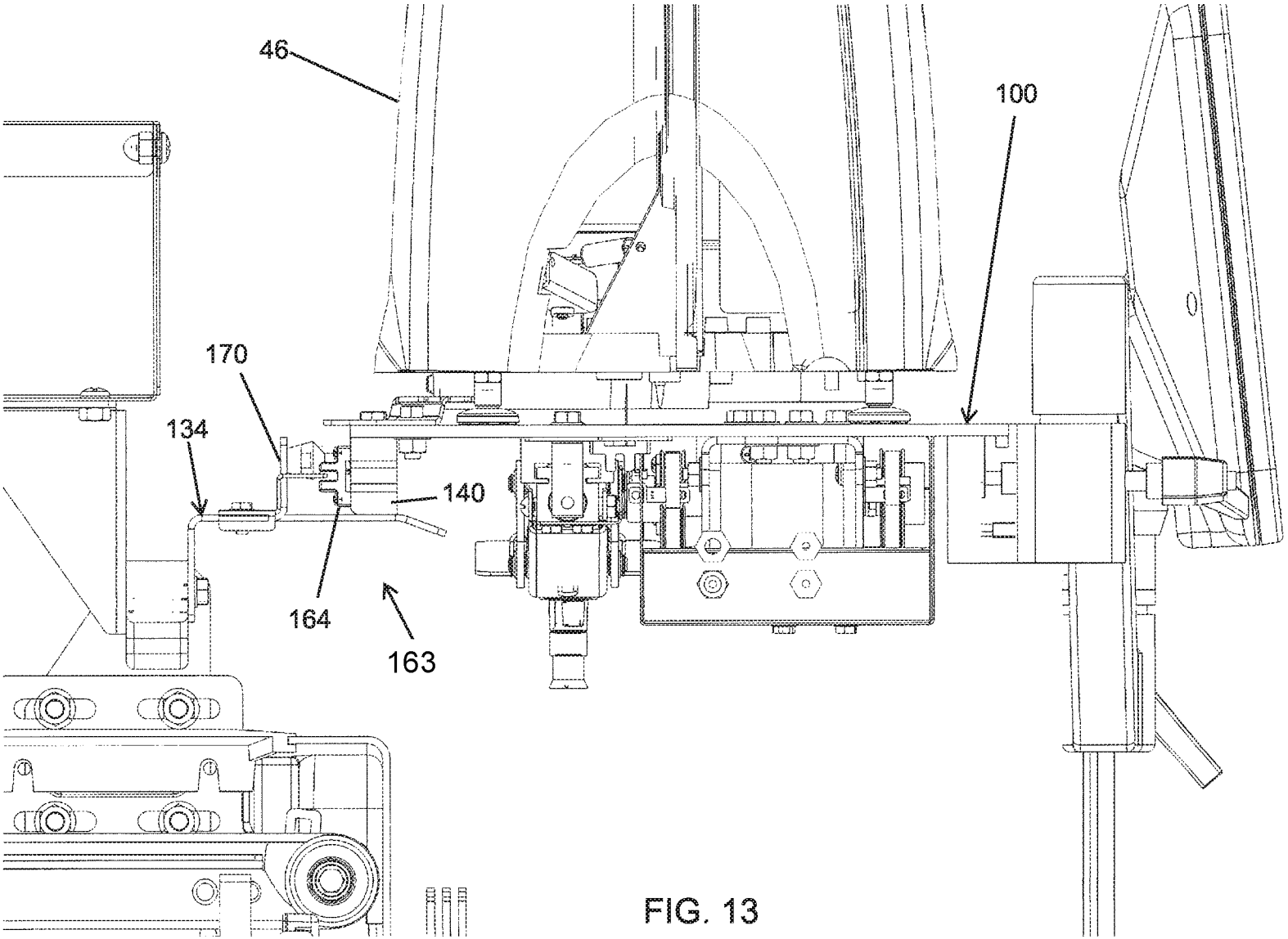
FIG. 13 is a partial side elevation of a printer support sensor arrangement.

As seen in FIGS. 12 and 13, a sensor arrangement 163 is also provided for detecting when the support 100 is in the operating position. Here, the sensor arrangement 163 is formed by a detector 164 fixed on the mount block 140 and forming a gap 166 that receives a free end 168 of a bracket 170 when the support 100 is in the operating position. When the support is pivoted to the access position, the detector 164 moves away from the bracket 170 and the free end 168 will no longer be positioned within the detector gap. The bracket is mounted on plate 134 to enable adjustment (e.g., per arrow 171) of the extent of the free end 168 within the gap 166 to assure proper triggering of the detector. By way of example, the detector may be an optical sensor with a light beam that is broken by the free end 168 when the support is in the operating position. Alternatively, the detector may be a magnetic detector to detect the positioning of the free end 168 in the gap. However, other sensor variations are possible, including variations in which a mechanical contact is engaged (e.g., mechanical switch closure). Regardless of the exact sensor configuration, the sensor may be connected with the machine controller (e.g., 50 in FIG. 3) and the controller may be configured to output an error message on an operator interface of the machine when the support 100 is not in the operating position. Likewise, the controller may be configured to prevent wrap operations when the support frame is not in the operating position or to shut down a wrap operation if the support moves out of the operating position mid-wrap. Any error message that is also sent, (e.g., to the interface 102) may identify the message and explain how the operator can resolve the problem (e.g., Move Printer To Operating Position).

Figure 14:
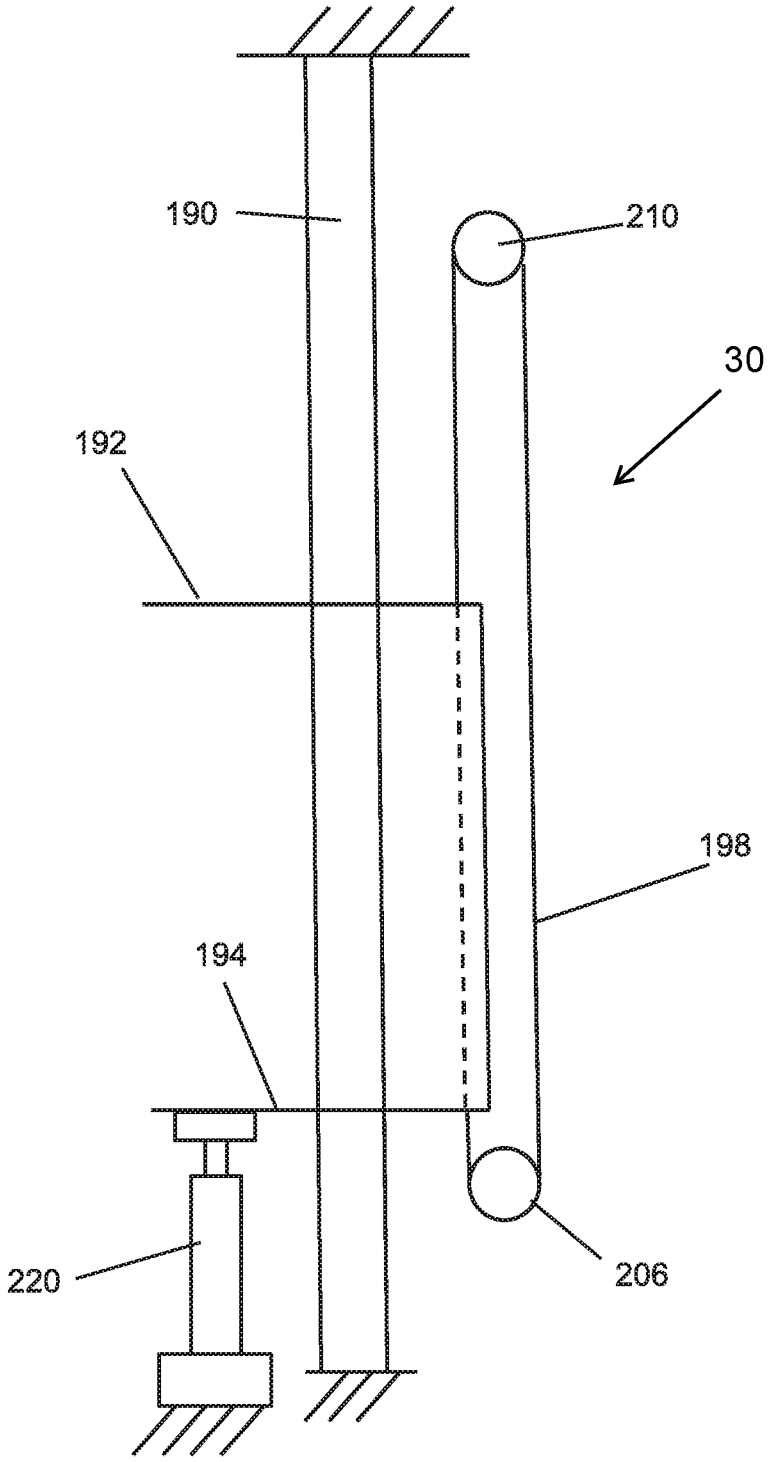
FIG. 14 is a schematic side view of a film knife arrangement.
Figure 15:
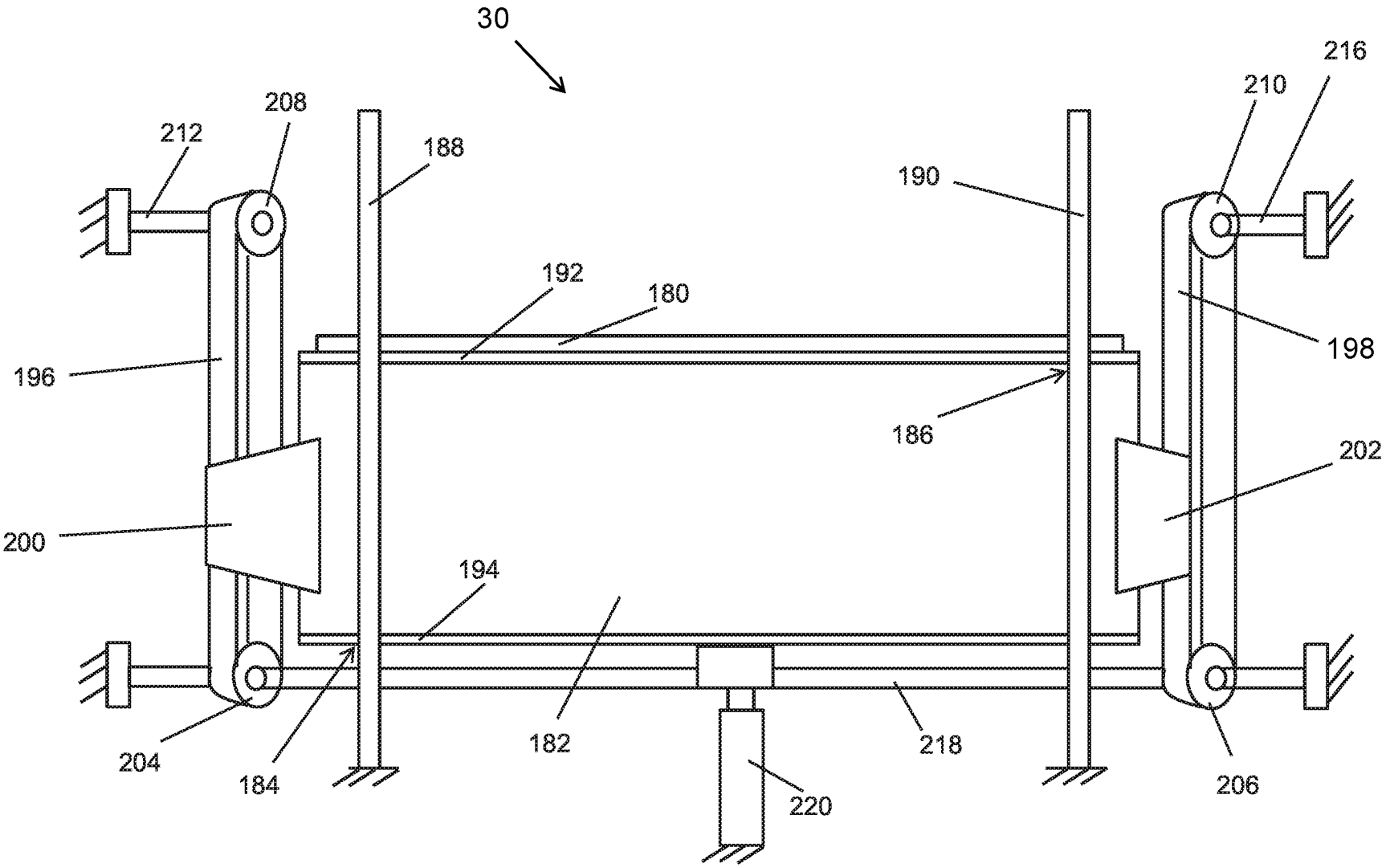
FIG. 15 is a partial perspective of the film knife arrangement.

Referring to the schematic depictions in FIGS. 14 and 15, a film knife arrangement 30 of the machine is shown in which the knife 180 is mounted on a knife frame 182 having opposed end portions 184, 186 that ride on spaced apart slide rods 188, 190. For this purpose, upper 192 and lower 194 flanges of the knife frame 182 may include aligned openings with sleeves (e.g., of plastic) therein to facilitate sliding along the rods 188, 190. Each end of the frame 182 is also linked to a respective belt 196, 198, such as by a bracket 200, 202 having one end that is attached to the belt. The belt portions to which the brackets are attached move along belt paths between pulley wheels. Here, each belt 196, 198 is coupled between a respective lower pulley wheel 204, 206 and upper pulley wheel 208, 210. Upper pulley 208 is mounted for free rotation on a shaft 212, and upper pulley 210 is mounted for free rotation on a shaft 216. Lower pulley wheels 204 and 206 are each mounted on a rotating shaft 218, so that the pulley wheels 204 and 206 are forced to rotate in synchronization. In one implementation, a linear actuator 220 (e.g., a pneumatic cylinder) is connected to a laterally central portion of the knife frame between the slide rods to push and pull the knife frame up and down. Here, the knife is moved upward through the film path to cut the film for wrap operations.

Notably, the above-described knife arrangement assures that the two spaced apart belts 196, 198 are mechanically linked so as to move in unison under control of the same prime mover (e.g., in the case the linear actuator 220) which assures that both ends of the knife frame 182 are kept in alignment and move in unison along the respective slide rods, which helps prevent jamming of the knife. In addition, only one sensor is needed to detect the knife start or home position (e.g., a lowered position) and only one sensor is needed to detect the knife end of travel position (e.g., an upper position).

In an alternative arrangement, the linear actuator could be eliminated and the shaft 218 driven directly by a single drive motor or other prime mover (e.g., rotating the shaft back and forth during for knife movement).

Thus, a wrapping machine for wrapping trayed food products, includes:

a wrap station at which trayed food products are wrapped;

a film dispensing system for drawing out a film at the wrap station;

a conveying system for moving trayed food products to the wrap station;

wherein the film dispensing system includes an elongated knife movable for cutting the film, a linear actuator positioned at a lateral mid-point of the elongated knife for effecting movement of the elongated knife in a direction substantially perpendicular to an elongated axis of the elongated knife, and a belt arrangement mechanically linking the opposite ends of the elongated knife to force substantially synchronized movement of the opposite ends so as to inhibit jamming.

It is to be clearly understood that the above description is intended by way of illustration and example only, is not intended to be taken by way of limitation, and that other changes and modifications are possible.

What is claimed is:

1. A wrapping machine for wrapping trayed food products, comprising:

a wrap station at which trayed food products are wrapped;

a film dispensing system for drawing out film at the wrap station;

a conveying system for moving trayed food products through the wrapping machine;

a printer and label apply arrangement positioned for applying labels to trayed food products after wrapping, the printer and label apply arrangement including a support that is pivotable between an operating position and an access position;

wherein the printer and label apply arrangement includes a printer housing including an internal space for holding a label supply, wherein the printer and label apply arrangement includes a label applier external of the printer housing, wherein both the printer housing and the label applier pivot with the support when the support pivots, wherein the printer housing includes a movable door for label replacement, wherein the movable door is configured to pivot relative to both a part of the printer housing and the support for movement between open and closed positions.

2. The machine of claim 1, wherein the machine includes a sensor arrangement for detecting when the support is in the operating position, and further comprising a controller associated with the sensor arrangement and configured to prevent wrap operations when the support is not in the operating position.

3. The machine of claim 2 wherein the controller is configured to output an error message on an operator interface of the machine when the support is not in the operating position.

4. The machine of claim 2 wherein the operator interface is mounted to the support for movement therewith during pivot of the support, and the operator interface is mounted to an arm that also pivots relative to the support.

5. The machine of claim 1 wherein the support is positioned over a sealer belt of the machine when in an operating position and pivots toward a front side of the machine when moving to the access position, the sealer belt running in a lateral direction of the machine.

6. The machine of claim 5 wherein wrapped packages feed onto one side of the sealer belt and a pivot axis of the support is located toward an opposite side of the sealer belt.

7. The machine of claim 1, wherein the machine includes a latch for releasably holding the support in the operating position, wherein the latch is formed by a ball detent, wherein the ball moves with the support and the detent is stationary.

8. A wrapping machine for wrapping trayed food products, comprising:

a wrap station at which trayed food products are wrapped;

a film dispensing system for drawing out film at the wrap station;

a conveying system for moving trayed food products through the wrapping machine;

a printer and label apply arrangement positioned for applying labels to trayed food products after wrapping, the printer and label apply arrangement including a support that is movable between an operating position for label application and an access position for changing out a label supply;

wherein the printer and label apply arrangement includes a printer housing including an internal space for holding a label supply, wherein the printer housing includes a movable door for label replacement, wherein the movable door is configured to pivot relative to both a part of the printer housing and the support during movement between open and closed positions.

9. The wrapping machine of claim 8, wherein the wrapping machine further includes at least one of:

a latch for releasably holding the support in the operating position; or a sensor arrangement for detecting a position of the support; or an operator interface mounted to the support for movement therewith.

10. The wrapping machine of claim 8, wherein the wrapping machine further includes each of:

a latch for releasably holding the support in the operating position; and a sensor arrangement for detecting a position of the support; and an operator interface mounted to the support for movement therewith.

11. The machine of claim 10, further comprising a controller associated with the sensor arrangement and configured to prevent wrap operations when the support is not in the operating position.

12. The machine of claim 8, further comprising:

an output conveyor for receiving trayed food products that have been wrapped, the output conveyor including an associated sealer belt;

wherein, in the operating position, the support is positioned over the sealer belt;

wherein, in the access position, the support is pivoted to extend away from the sealer belt.

13. The machine of claim 8, wherein the movable door faces and opens toward a rear side of the wrapping machine when the support is in the operating position.

14. The machine of claim 8, further comprising:

an operator interface;

wherein the operator interface is mounted to the support for movement therewith.

15. A wrapping machine for wrapping trayed food products, comprising:

a wrap station at which trayed food products are wrapped;

a film dispensing system for drawing out film at the wrap station;

a conveying system for moving trayed food products through the wrapping machine;

a printer and label apply arrangement positioned for applying labels to trayed food products after wrapping, the printer and label apply arrangement mounted on a support frame that is pivotable between an operating position and an access position;

wherein the printer and label apply arrangement includes a printer mounted atop the support frame;

wherein the printer and label apply arrangement includes a label applier external of the printer and mounted on the support frame adjacent a label exit slot of the printer;

wherein both the printer and label applier pivot with the support frame.

* * * * *